United States Patent [19]

Ide et al.

[11] Patent Number: 4,605,917

[45] Date of Patent: Aug. 12, 1986

[54] COIL WIRE

[75] Inventors: Tatsumi Ide; Toshifumi Sakurai, both of Tokyo; Masahiro Izumi, Kanagawa; Kimio Sugimura, Aichi, all of Japan

[73] Assignee: NEC Corporation, Japan

[21] Appl. No.: 532,189

[22] Filed: Sep. 14, 1983

[30] Foreign Application Priority Data

| | | | |
|---|---|---|---|
| Sep. 14, 1982 | [JP] | Japan | 57-161438 |
| Sep. 14, 1982 | [JP] | Japan | 57-161439 |
| Sep. 14, 1982 | [JP] | Japan | 57-161440 |

[51] Int. Cl.[4] ..... H01H 51/08

[52] U.S. Cl. ..... 335/128; 335/154; 174/120 SR; 428/383

[58] Field of Search ..... 335/154, 128; 174/120 SR, 110 SR, 110 F; 428/375, 379, 383

[56] References Cited

U.S. PATENT DOCUMENTS

| | | | |
|---|---|---|---|
| 3,321,722 | 5/1967 | Cohen | 335/128 |
| 4,170,673 | 10/1979 | Conti | 428/375 |
| 4,379,807 | 4/1983 | Otis et al. | 428/383 |
| 4,400,430 | 8/1983 | Miyake et al. | 428/379 |

*Primary Examiner*—Harold Broome

*Attorney, Agent, or Firm*—Ostrolenk, Faber, Gerb & Soffen

[57] ABSTRACT

A coil wire has a lubricant film formed on an outer surface of an insulation film covering a conductor. The lubricant film is made of polypropylene glycol or a material obtained by substituting a hydrogen atom at at least one end of polypropylene glycol with another reactive group so as to provide a coil wire wherein generation of organic gases can be suppressed.

14 Claims, 10 Drawing Figures

| EVALUATION ITEM / VALUE / SAMPLE (LUBRICANT) | (1) | (2) | | (3) |
|---|---|---|---|---|
| | SURFACE CONTACT RESISTANCE OF Au-PLATED TEST PIECE AFTER EXPOSURE (mΩ) | CONTACT RESISTANCE | AMOUNT OF BROWN POWDER * | NUMBER OF CONTACT OPERATIONS BEFORE CONTACT ACTIVATION |
| SPINDLE OIL | 7.5 | INCREASED | LARGE | 300 |
| PARAFFIN | 15 OR MORE | INCREASED | LARGE | 700 |
| POLYPROPYLENE GLYCOL (AVERAGE MOLECULAR WEIGHT:400) | 5.0 | STABLE | SMALL | 4000 |
| POLYPROPYLENE GLYCOL (AVERAGE MOLECULAR WEIGHT:1000) | 4.5 | STABLE | SMALL | 5000 |
| POLYPROPYLENE GLYCOL (AVERAGE MOLECULAR WEIGHT:2000) | 4.2 | STABLE | SMALL | 7000 |
| POLYOXYPROPYLENE MONO BUTYL ETHER (AVERAGE MOLECULAR WEIGHT:700) | 4.0 | STABLE | SMALL | 10000 |
| POLYOXYPROPYLENE MONO BUTYL ETHER (AVERAGE MOLECULAR WEIGHT:2500) | 4.3 | STABLE | SMALL | 14000 |
| POLYOXYPROPYLENE MONO PROPYL ETHER (AVERAGE MOLECULAR WEIGHT:1000) | 4.5 | STABLE | SMALL | 8000 |

* BROWN POWDER: HIGH-ELECTRICAL RESISTANCE ORGANIC COMPOUND WHICH IS CREATED BY FRICTIONAL ENERGY DURING CONTACT OPERATION

FIG.6A

| EVALUATION ITEM / VALUE / SAMPLE (LUBRICANT) | (1) | (2) | | (3) |
|---|---|---|---|---|
| | SURFACE CONTACT RESISTANCE OF Au-PLATED TEST PIECE AFTER EXPOSURE (m.Ω) | CONTACT RESISTANCE | AMOUNT OF BROWN POWDER | NUMBER OF CONTACT OPERATIONS BEFORE CONTACT ACTIVATION |
| SPINDLE OIL | 7.5 | INCREASED | LARGE | 300 |
| PARAFFIN | 15 OR MORE | INCREASED | LARGE | 700 |
| POLYOXYETHYLENE PROPYLENE GLYCOL | 5.0 | STABLE | SMALL | 7000 |
| POLYOXYETHYLENE PROPYLENE FATTY ACID METHYL ESTER | 4.5 | STABLE | SMALL | 15000 |

FIG.6B

| SAMPLE (LUBRICANT) / EVALUATION ITEM / VALUE | | (1) SURFACE CONTACT RESISTANCE OF Au-PLATED TEST PIECE AFTER EXPOSURE (mΩ) | (2) CONTACT RESISTANCE | (2) AMOUNT OF BROWN POWDER | (3) NUMBER OF CONTACT OPERATIONS BEFORE CONTACT ACTIVATION |
|---|---|---|---|---|---|
| SPINDLE OIL | | 7.5 | INCREASED | LARGE | 300 |
| PARAFFIN | | 15 OR MORE | INCREASED | LARGE | 700 |
| POLYOL ESTER | TRIMETHYLOLPROPANE TRICAPRINIC ESTER | 6 | STABLE | SMALL | 4000 |
| | NEOPENTYL GLYCOL DICAPRINIC ESTER | 6.5 | STABLE | SMALL | 6000 |

FIG.6C

| EVALUATION ITEM / SAMPLE (LUBRICANT) / VALUE | (1) | (2) | | (3) |
|---|---|---|---|---|
| | SURFACE CONTACT RESISTANCE OF Au-PLATED TEST PIECE AFTER EXPOSURE (mΩ) | NUMBER OF CONTACT OPERATIONS AFTER WHICH 10% OR MORE OF THE TEST PIECE HAS A CONTACT RESISTANCE OF 1Ω OR HIGHER | AMOUNT OF BROWN POWDER | NUMBER OF CONTACT OPERATIONS BEFORE CONTACT ACTIVATION |
| CONVENTIONAL CRESOL SOLVENT | 5 | 300000 | LARGE | 600 |
| KA SOLVENT | 6 | 9000000 | SMALL | 5000 |
| SOLVENT MIXTURE OF XYLENOL AND ALCOHOL | 6 | 9000000 | SMALL | 5000 |

FIG.7

| EVALUATION CONDITIONS | EVALUATION ITEM | CONVENTIONAL COIL WIRE | COIL WIRE OF THE PRESENT INVENTION |
|---|---|---|---|
| HIGH-TEMPERATURE EXPOSURE TEST (120°) | CONTACT RESISTANCE | INCREASED | STABLE |
| RESISTANCE LOAD TRANSIENT TEST (DC48V-10mA;70°C) | CONTACT RESISTANCE | INCREASED | STABLE |
| RESISTANCE LOAD TRANSIENT TEST (DC48V-0.5A;70°C) | CONTACT RESISTANCE | STABLE | STABLE |
| | ARC DURATION | INCREASED AT THE INITIAL STAGE (LARGE AMOUNT OF CARBON) | SLIGHTLY INCREASED (SMALL AMOUNT OF CARBON) |

FIG.8

COIL WIRE

BACKGROUND OF THE INVENTION

I. Field of the Invention

The present invention relates to a coil wire and, more particularly, to a coil wire used for an excitation winding of a sealed electric device such as an electromagnetic relay.

II. Description of the Prior Art

A conventional coil wire for an excitation winding of a sealed electric device such as an electromagnetic relay obtained by sealing the excitation winding together with contact members in a case in a given hermetic state so as to electromagnetically drive the contact members is prepared in the following manner. An electrically insulating coating material such as a polyurethane resin or polyimide resin which is dissolved in a solvent mixture comprising a solvent containing cresol, a phenol and a benzene nucleus is applied to the outer surface of a conductor, such as copper, and is baked. Thereafter, a lubricant such as paraffin or spindle oil is applied to the outer surface of the insulation film to smoothen the surface of the resultant wire and hence to prevent a disconnection during manufacture of the winding. However, when an enamel coil wire of the type described above is used for the excitation winding of a plastic sealed relay, the residual solvent in the insulation film of the winding and the lubricant component are evaporated upon operation of the relay to generate organic gases inside the sealed case. As a result, the contact resistance of the contact members which are closed/opened with respect to each other tends to increase, and contact activation will result. Therefore, contact wear is greatly increased.

SUMMARY OF THE INVENTION

It is, therefore, an object of the present invention to improve a composition of a lubricant film formed on an outer surface of an insulation film covering a conductor so as to provide a coil wire wherein generation of organic gases can be suppressed.

It is another object of the present invention to provide a coil wire which can prevent generation of the organic gases and which is prepared by dissolving a resin of the insulation film in a solvent removed of cresol or phenols, and applying a resultant compound to the outer surface of the conductor.

According to an aspect of the present invention, the lubricant film formed on the outer surface of the insulation film covering the conductor is made of polypropylene glycol or material (e.g., polyoxypropylene mono butyl ether or polyoxypropylene mono propyl ether) obtained by substituting a hydrogen atom at at least one end of polypropylene glycol with another reactive group.

According to another aspect of the present invention, the lubricant film formed on the outer surface of the insulation film covering the conductor is made of polyoxyethylene propylene glycol or a material such as polyoxyethylene propylene fatty acid methyl ester (tradename of an equivalent: Nippon Oil Unisafe 40MT1015 manufactured by Nippon Oil & Fats CO., Ltd.) obtained by substituting a hydrogen atom at at least one end of polyoxyethylene propylene glycol.

According to still another aspect of the present invention, the lubricant film formed on the outer surface of the insulation film covering the conductor is made of a polyol ester (eg., trimethyolpropane tricaprinic ester and neopentyl glycol dicaprinic ester).

According to still another aspect of the present invention, the insulating film of the coil wire having any one of the aforementioned lubricant films is made of a polyurethane resin dissolved in KA solvent (tradename: 30% of solvent naphtha and 70% of cellsolve acetate butyrate).

According to still another aspect of the present invention, the insulation film of the coil wire is made of a polyurethane resin dissolved in a solvent mixture of xylenol and alcohol.

BRIEF DESCRIPTION OF THE DRAWINGS

The above and other objects and features of the present invention will be apparent from the following detailed description with reference to the accompanying drawings, in which:

FIGS. 6A, 6B and 6C are tables showing evaluation results of respective lubricants for forming lubricant films of the coil wires of the present invention FIG. 7 is a table showing evaluation results of solvents for forming insulating films of the coil wires of the present invention; and FIG. 8 is a table showing evaluation results of coil wires as whole.

DETAILED DESCRIPTION OF THE PREFERRED EMBODIMENTS

Figure 1:
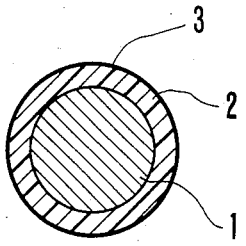
FIG. 1 is a sectional view of a coil wire of the present invention.
Figure 2:
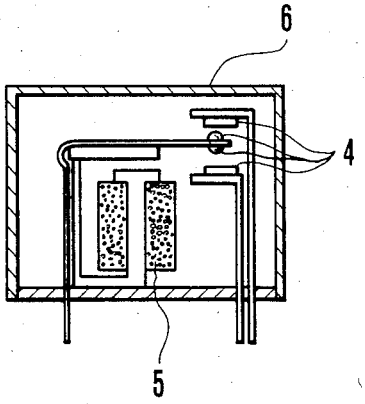
FIG. 2 is a sectional view showing an electromagnetic relay to which the coil wire of the present invention is applied.
Figure 3:
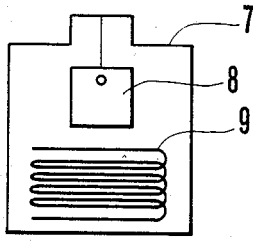
FIGS. 3, 4 and 5 are representations showing respective test devices for evaluating the coil wires of the present invention.
Figure 4:
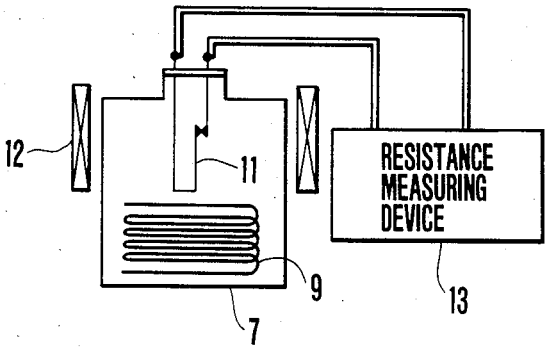
Figure 5:
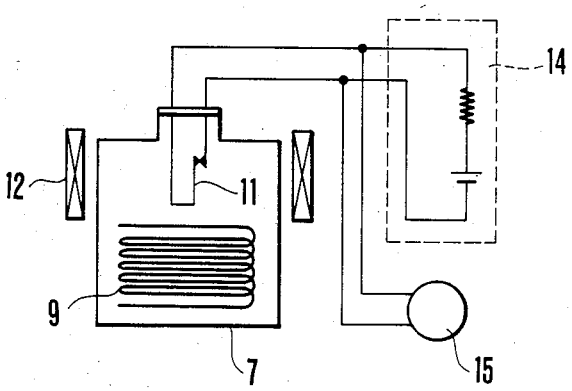

In order to solve the above-mentioned conventional problem caused by a coil wire in which a lubricant film 3 is formed on an outer surface of an insulation film 2 covering a conductor 1 as shown in FIG. 1, influences of an improved solvent for dissolving a resin of an insulation film and of an improved lubricant for forming a lubricant film 3 were examined independently of each other. Furthermore, an influence of the coil wire as a whole was then examined. As shown in FIG. 2, an electric device such as an electromagnetic relay is arranged such that contact members 4 are disposed in a sealed case 6 together with an excitation winding 5 for electromagnetically driving the contact members 4. Even if organic gases are generated from the coil wire applied as the excitation winding 5 of this relay, it is preferred that these gases (1) do not cause an increase in a contact resistance of the contact members 4, (2) do not cause an increase in the contact resistance thereof due to mechanochemical reaction products upon opening/-closing operation of the contact members 4, and (3) do not cause an increase in an amount of carbon produced by arcing or an increase in an arc duration (i.e., do not cause an increase in the contact wear). In order to evaluate these characteristics of the organic gases and to test the influences of the improved solvent and lubricant, test devices shown in FIGS. 3, 4 and 5 were used.

These test devices will be described in detail hereinafter. In the test device shown in FIG. 3, a gas evaporated from a sample 9 within a hermetic chamber 7 is deposited on the surface of a gold-plated test piece 8 so as to test how the deposited material increases the surface contact resistance of the gold-plated test piece 8. The surface contact resistance is measured in accordance with a four-point probe technique using a pure gold probe at a contact load of 1 gram after the test piece has been exposed in the chamber for 200 hours. In the test device shown in FIG. 4, an increase in a contact resistance of contact members 11 through an insulation film formed on the contact members 11 upon energization of a coil 12 is measured by a four-point probe contact resistance measuring device 13. In the test device shown in FIG. 5, a load circuit 14 is connected to contact members 11 to be tested. The contact members 11 are then driven with the load circuit 14 loaded in an atmosphere of an organic gas to produce an arc. An arc duration is continuously monitored by an oscilloscope 15, so that the number of times of ON/OFF operation of the relay required to abruptly increase the arc duration is measured. This increase in the arc duration is called contact activation. It is preferred that the contact member can withstand a great number of switching operations and retain a short arc duration. The influence of the sample to be tested can be understood by the number of switching operations required to produce contact activation. It should be noted that the above tests are performed at a temperature of 120 ° C.

The test results of sample lubricants and solvents for evaluation items (1), (2) and (3) obtained using the above test devices are shown in FIGS. 6A, 6B, 6C and FIG. 7.

Referring to FIG. 6A, spindle oil and paraffin which are conventionally used as a lubricant have poor characteristics, while polypropylene glycols (average molecular weights: 400, 1000 and 2000), polyoxypropylene mono butyl ethers (average molecular weights: 700 and 2500), and polyoxypropylene mono propyl ether (average molecular weight: 1000) have good characteristics, throughout the evaluation items (1) to (3) described previously. The last two materials are obtained by substituting a hydrogen atom at one end of polypropylene glycol with a reactive group. The same effect can be obtained in any homologous material. In other words, the above-mentioned good characteristics are based upon the properties of polypropylene glycol. The average molecular weight of this material greatly influences the allowable range of viscosity when it is applied as the lubricant film of the wire.

Referring to FIG. 6B, spindle oil and paraffin which are conventionally used as a lubricant have poor characteristics, while polyoxyethylene propylene glycol (block polymer, polypropylene glycol: molecular weight of 1750, ethylene oxide: 10%) and polyoxyethylene propylene fatty acid methyl ester have good characteristics, throughout the evaluation items. The latter materials are obtained by etherification and esterification of a hydrogen atom at one end of polyoxyethylene propylene glycol. Therefore, the same effect as obtained using these materials can be obtained using homologous materials. The above-mentioned good characteristics are obtained in accordance with the properties of polyoxyethylene propylene glycol.

Furthermore, referring to FIG. 6C, spindle oil and paraffin which are conventionally used as a lubricant have poor characteristics, while polyol esters (trimethylolpropane tricaprinic ester and neopentyl glycol dicaprinic ester) have good characteristics, throughout the evaluation items.

Referring to FIG. 7, as compared with a conductor having an insulation film of a solvent containing cresol without the conventional lubricant film, it is readily seen that a solvent of the present invention (i.e., KA solvent) shows good characteristics in evaluation items (2) and (3) excepting evaluation item (1). Furthermore, in the present invention, when a solvent mixture consisting of 40% or less of xylenol and a balance comprising cellsolve acetate butyrate or an alcohol solvent which does not contain a benzene nucleus is applied to the present invention, the good characteristics as previously described can be obtained.

In a coil wire according to a first embodiment of the present invention based on the evaluation results described above, a lubricant film is made of one of polypropylene glycol, polyoxypropylene mono butyl ether, and polyoxypropylene mono propyl ether. An insulation film of the coil of this embodiment is formed using a conventional solvent. The average molecular weight of polypropylene glycol having an effect on the required viscosity of the lubricant may be about 1,000 without changing conventional winding manufacturing techniques. However, when washing or baking is performed before or after the winding is carried out, the average molecular weight can vary in a range of not more than 2,000. Polyoxypropylene mono butyl ether and polyoxypropylene mono propyl ether can be used in the same manner as polypropylene glycol. In order to evaluate the wire of this embodiment, six types of coil wires were prepared such that polypropylene glycol, polyoxypropylene mono butyl ether and polyoxypropylene mono propyl ether were respectively formed as lubricant films on outer surfaces of conventional enamel wires respectively having insulation films of a polyurethane resin and a polyimide resin. Furthermore, four types of coil wires were also prepared such that spindle oil and paraffin were applied as lubricant films to respective conventional enamel wires of the type described above. These 10 types of coil wires were used to form excitation windings, respectively. These excitation windings were mounted in sealed electro-magnetic relays, as shown in FIG. 2, so as to test the performance of the contact members. Obtained test results are shown in FIG. 8. The contact performance of the six types of coil wires prepared according to the first embodiment of the present invention gave good results in a high-temperature exposure test, a resistance load transient test (DC 48 V - 10 mA) and a resistance load transient test (DC 48 V - 0.5 A), as compared with the four types of coil wires described above. Furthermore, the six types of coil wires gave good results in the three evaluation items for evaluating only coil wires. The first embodiment of the present invention may be applied to other enamel wires (e.g., polyimide amide wires and polyester wires) in the same manner as described above.

A second embodiment of a coil wire of the present invention will be described hereinafter. According to this embodiment, KA solvent described in detail with reference to FIG. 7 was used as a solvent for forming the insulation film. The lubricant of the first embodiment was used to prepare a polyurethane wire. The second embodiment can be obtained in the same manner as described above when a solvent mixture of xylenol and alcohol is used in place of the KA solvent. In the second embodiment, these solvents cannot be satisfactorily used for a heat-resistant wire such as a polyimide wire from the viewpoint of solvent power. Therefore the solvent mixture described above is preferably used for a polyurethane wire. As compared with the conventional coil wire obtained by applying spindle oil as the lubricant to the polyurethane wire having the conventional cresol-containing solvent in an insulation film and the coil wire of the first embodiment, the coil wire of the second embodiment gave the best results in the evaluation conditions shown in FIG. 8. In the second embodiment, cresol or the like is not contained in the polyurethane resin of the insulation film, and the lubricant film is made of polypropylene glycol or the like. As a result, influences of the resultant wire on the contact members can be further decreased.

In order to evaluate the coil wire of a third embodiment, four types of coil wires were prepared such that polyoxyethylene propylene glycol and polyoxyethylene propylene fatty acid methyl ester were applied as lubricant films to insulation films of a polyurethane resin and a polyimide resin of the conventional enamel wires. Similarly, four types of conventional coil wires were prepared such that spindle oil and paraffin were applied as lubricant films to conventional enamel wires of the type described above. The eight types of coil wires were formed into excitation windings which were respectively mounted in sealed electromagnetic relays shown in FIG. 2. The performance of contact members of these relays were tested. Test results are shown in FIG. 8. The contact members of the four types of coil wires obtained according to the third embodiment of the present invention showed good characteristics in the high-temperature exposure test, the resistance load transient test (DC 48 V - 10 mA) and the resistance load transient test (DC 48 V - 0.5 A), as compared with the four types of conventional coil wires. Furthermore, the coil wires according to the third embodiment showed good characteristics in the three evaluation items, as shown in FIG. 6B. The third embodiment of the present invention can also be applied to other enamel wires (e.g., polyimide amide wires and polyester wires).

According to a fourth embodiment of the coil wire of the present invention, KA solvent described in detail with reference to FIG. 7 was used as a solvent for forming the insulation film. The lubricant of the third embodiment was used to prepare a polyurethane wire. The fourth embodiment can be performed in the same manner as described above when a solvent mixture of xylenol and alcohol is used in place of the KA solvent. In the fourth embodiment, these solvents cannot be satisfactorily used for a heat-resistant wire such as a polyimide wire from the viewpoint of solvent power. Therefore, the solvent mixture described above is preferably used for a polyurethane wire. As compared with the conventional coil wire obtained by applying spindle oil as the lubricant to the polyurethane wire having the conventional cresol-containing solvent in an insulation film and the coil wire of the third embodiment, the coil wire of the fourth embodiment gave the best results in the evaluation conditions shown in FIG. 8. In the fourth embodiment, cresol or the like is not contained in the polyurethane resin of the insulation film, and the lubricant film is made of polyoxyethylene propylene glycol or the like. As a result, influences of the resultant wire on the contact members can be further decreased.

In a fifth embodiment of the coil wire of the present invention, a lubricant film of the coil wire was formed by one of trimethylolpropane tricaprinic ester and neopentyl glycol dicaprinic ester. An insulation film of this coil wire comprised the conventional solvent. Trimethylolpropane tricaprinic ester and neopentyl glycol dicaprinic ester were applied as lubricant films to the outer surfaces of insulation films of a polyurethane resin and a polyimide resin of conventional enamel wires to prepare four types of coil wires according to the fifth embodiment. Similarly, spindle oil and paraffin were applied as lubricant films to the outer surfaces of the insulation films of respective conventional enamel wires of the type described above to prepare four types of conventional coil wires. These coil wires were used to form excitation windings which were mounted in respective sealed electromagnetic relays as shown in FIG. 2 so as to test contact members of the relays. Test results are shown in FIG. 8. The contact members of the four types of coil wires obtained according to the fifth embodiment of the present invention showed good characteristics in the high-temperature exposure test, the resistance load transient test (DC 48 V - 10 mA) and the resistance load transient test (DC 48 V - 0.5 A), as compared with the four types of conventional coil wires. Furthermore, the coil wires according to the fifth embodiment showed good characteristics in the three evaluation items, as shown in FIG. 6C. The fifth embodiment of the present invention can also be applied to other enamel wires (e.g., polyimide amide wires and polyester wires).

In a sixth embodiment of the coil wire of the present invention, KA solvent described in detail with reference to FIG. 7 was used as a solvent for forming the insulation film. The lubricant of the fifth embodiment was used to prepare a polyurethane wire. The sixth embodiment can be obtained in the same manner as described above when a solvent mixture of xylenol and alcohol is used in place of the KA solvent. In the sixth embodiment, these solvents cannot be satisfactorily used for a heat-resistant wire such as a polyimide wire from the viewpoint of solvent power. Therefore, the solvent mixture described above is preferably used for a polyurethane wire. As compared with the conventional coil wire obtained by applying spindle oil as the lubricant to the polyurethane wire having the conventional cresol-containing solvent in an insulation film and the coil wire of the fifth embodiment, the coil wire of the sixth embodiment gave the best results in the evaluation conditions shown in FIG. 8. In the sixth embodiment, cresol or the like is not contained in the polyurethane resin of the insulation film, and the lubricant film is made of polyol ester. As a result, influences of the resultant wire on the contact members can be further decreased.

What is claimed is:

1. In an electric device comprising an excitation winding together with contact members in a container held in a given hermetic condition, said contact members being eletromagnetically driven by said excitation winding, the improvement which comprises a coil wire constituting said excitation winding, said coil wire comprising a conductor, an insulation film formed on the conductor, and a lubricant film formed on the outer surface of the insulation film, said lubricant film comprising a member of the group consisting of a polypropylene glycol, and a material obtained by substituting a reactive group for a hydrogen at at least one end of polypropylene glycol.

2. The electric device according to claim 1, wherein said material comprises polyoxypropylene mono butyl ether.

3. The electric device according to claim 1, wherein said material comprises polyoxypropylene mono propyl ether.

4. The electric device according to claim 1, wherein said insulation film comprises a polyurethane resin dissolved in a solvent mixture of xylenol and alcohol.

5. The electric device according to claim 1, wherein said insulation film comprises a polyurethane resin dissolved in the combination of naphtha and cellulose acetate butyrate.

6. In an electric device comprising an excitation winding together with contact members in a container held in a given hermetic condition, said contact members being electromagnetically driven by said excitation winding, the improvement which comprises a coil wire constituting said excitation winding, said coil wire comprising a conductor, an insulation film formed on the conductor, and a lubricant film formed on the outer surface of the insulation film, said lubricant film comprising a member of the group consisting of polyoxyethylene propylene glycol and a material obtained by substituting a reactive group for a hydrogen at at least one end of polyoxyethylene propylene glycol.

7. The electric device according to claim 6, wherein said material comprises polyoxyethylene propylene fatty acid methyl ester.

8. The electric device according to claim 6, wherein said insulation film comprises a polyurethane resin dissolved in a solvent mixture of xylenol and alcohol.

9. The electric device according to claim 6, wherein said insulation film comprises a polyurethane resin dissolved in the combination of naphtha and cellulose acetate butyrate.

10. In an electric device comprising an excitation winding together with contact members in a container held in a give hermetic condition, said contact members being electromagnetically driven by said excitation winding, the improvement which comprises a coil wire constituting said excitation winding, said coil wire comprising a conductor, an insulation film formed on the conductor and a lubricant film formed on the outer surface of the insulation film, said lubricant film comprising a polyolester.

11. The electric device according to claim 10, wherein said lubricant film comprises trimethylolpropane tricaprinic ester.

12. The electric device according to claim 10, wherein said lubricant film comprises neopentyl glycol dicaprinic ester.

13. The electric device according to claim 10, wherein said insulation film comprises a polyurethane resin dissolved in a solvent mixture of xylenol and alcohol.

14. The electric device according to claim 10 wherein the insulation film comprises a polyurethane resin dissolved in the combination of naphtha and cellulose acetate butyrate.

* * * * *